US006225588B1

(12) United States Patent
Kaneko

(10) Patent No.: US 6,225,588 B1
(45) Date of Patent: May 1, 2001

(54) TRIP DEVICE OF CIRCUIT BREAKER

(75) Inventor: Shozo Kaneko, Izumi (JP)

(73) Assignee: Terasaki Denki Sangyo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/390,848

(22) Filed: Sep. 7, 1999

(30) Foreign Application Priority Data

Sep. 28, 1998 (JP) ..... 10-273046

(51) Int. Cl.[7] ..... H01H 33/34
(52) U.S. Cl. ..... 218/154; 335/172; 218/157
(58) Field of Search ..... 335/23–25, 167–176, 335/154–5

(56) References Cited

U.S. PATENT DOCUMENTS 3,631,369 * 12/1971 Menocal ..... 218/22
3,787,648 * 1/1974 Kawasaki ..... 218/154
4,375,022 2/1983 Daussin et al. .
4,521,756 6/1985 Forsell .
4,943,691 * 7/1990 Mertz et al. ..... 200/151

FOREIGN PATENT DOCUMENTS 3-101023 4/1991 (JP) .

* cited by examiner

*Primary Examiner*—Lincoln Donovan
(74) *Attorney, Agent, or Firm*—McDermott, Will & Emery

(57) ABSTRACT

A trip device of a circuit breaker that operates speedily when an enormous abnormal current such as short-circuit current flows is provided. The trip device includes a pressure detection space having a wall portion formed of a repeatedly usable thin plate, an operating rod which protrudes from the pressure detection space when the pressure in the pressure detection space increases, and a return spring which returns the operating rod. The pressure detection space is arranged in the vicinity of switching contacts, and the operating rod is arranged to release a trip latch mechanism when it protrudes.

6 Claims, 5 Drawing Sheets

TRIP DEVICE OF CIRCUIT BREAKER

BACKGROUND OF THE INVENTION

1. Field of the Invention

The present invention relates to a trip device of a circuit breaker to break such a high current as short-circuit current as quickly as possible.

2. Description of the Background Art

There is a circuit breaker which is enclosed in a casing formed of an insulating molding. The circuit breaker is composed of switching contacts, an operating mechanism which opens/closes the switching contacts, a trip device which automatically releases a trip latch mechanism, when overcurrent flows, for working the operating mechanism to open the switching contacts, and an arc-extinguishing device for irresistibly extinguishing arc which is generated when the switching contacts are opened so as to break the current.

Generally, in an electric circuit, if the circuit breaker breaks an enormous abnormal current which occurs due to a short-circuit accident in the electric circuit as immediately as possible to limit the current flowing through the circuit to a small magnitude, the damage to the electric circuit can be made minimum and accordingly the damage to the circuit breaker itself can be reduced. Therefore, the circuit breaker which can more speedily break the short-circuit current can accordingly break a high short-circuit current immediately, so that the rated breaking capacity thereof can be increased.

The electromagnet is applied to a trip device of a conventional circuit breaker which operates upon occurrence of a short-circuit current. The electromagnet operates when the current flowing through a main circuit conductor of the circuit breaker exceeds a predetermined threshold so as to release the trip latch mechanism included in the operating mechanism and thus open the switching contacts.

Such an electromagnet is slow in operation due to inertia of a movable core, and thus it is impossible to break more speedily the short-circuit current when the current exceeds a threshold. In particular, when an enormous abnormal current flows to cause the switching contacts to repel each other due to the electromagnetic force and consequently the switching contacts are opened, the contacts could be brought into contact again unless the trip latch mechanism is immediately released. In such a case, the circuit breaker itself could suffer a great damage.

SUMMARY OF THE INVENTION

One object of the present invention is to provide a trip device of a circuit breaker which can speedily operate in a reliable manner.

According to an aspect of the present invention, a trip device of a circuit breaker operates the circuit breaker that includes switching contacts, an operating mechanism which opens and closes the switching contacts, a trip latch mechanism which works the operating mechanism when released to open the switching contacts, and a housing which encloses at least the switching contacts. The trip device includes a pressure detection space having a wall portion with a repeatedly usable thin plate, an operating rod which protrudes from the pressure detection space when the pressure in the pressure detection space increases, and a return spring which returns the operating rod. The pressure detection space is arranged in the vicinity of the switching contacts, and the operating rod is arranged to release the trip latch mechanism when it protrudes.

In such a structure, when a great abnormal current flows to cause electromagnetic repulsion force and accordingly the switching contacts are opened, arc gas of high temperature and pressure is instantaneously generated and thus the wall portion having the thin plate of the pressure detection space is pressurized. The thin plate then yields to the pressure so that the internal pressure increases to cause the operating rod to protrude and accordingly release the trip latch mechanism. Consequently, the operating mechanism works immediately to complete the tripping operation. During this operation, the arc gas just directly pressurizes the thin plate which surrounds the pressure detection space, and any piece of metallic material that is melted in the vicinity of the switching contacts due to high temperature does not interrupts the movement according to the operating mechanism. In addition, the arc gas itself does not work the trip latch mechanism in order to release it, therefore, the trip latch mechanism and its surroundings are not exposed to the arc gas. After the abnormal current is broken, the arc gas disappears so that the internal pressure of the housing of the switching contacts becomes the atmospheric pressure to return the thin plate to its original shape. As a result, the internal pressure of the pressure detection space returns to its original state, the operating rod is also returned by the return spring, and accordingly, a waiting state to prepare for the next breaking operation starts.

According to another aspect of the invention, the pressure detection space of the trip device of the circuit breaker in the above one aspect of the invention is placed in a cavity which is formed within a wall of the housing, and a through hole is formed at a wall which separates the cavity containing the pressure detection space from the housing enclosing the switching contacts. Any special material or space for arranging the pressure detection space is thus unnecessary and the structure is simplified.

According to still another aspect of the invention, the pressure detection space of the trip device of the circuit breaker in the above one aspect of the invention is composed of a cavity which is formed within a wall of the housing, a through hole which is made at a wall which separates the cavity from the housing, and a thin plate formed to close the through hole.

The wall of the housing itself can be utilized as the pressure detection space, and thus a simplified structure is realized.

According to the another and still another aspects of the invention concerning the trip device of the circuit breaker, the circuit breaker is of a multipole type which has switching contacts in each pole, and a pressure detection space common to different poles adjacent to each other is placed at a wall of the housing which separates the adjacent poles. The structure is thus simplified since the trip device need not be provided at each pole.

In the trip device of the circuit breaker according to any aspect of the invention, a small opening is provided to the pressure detection space so as to allow the outside air to flow. Accordingly, the pressure detection space can easily be returned after pressurization.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
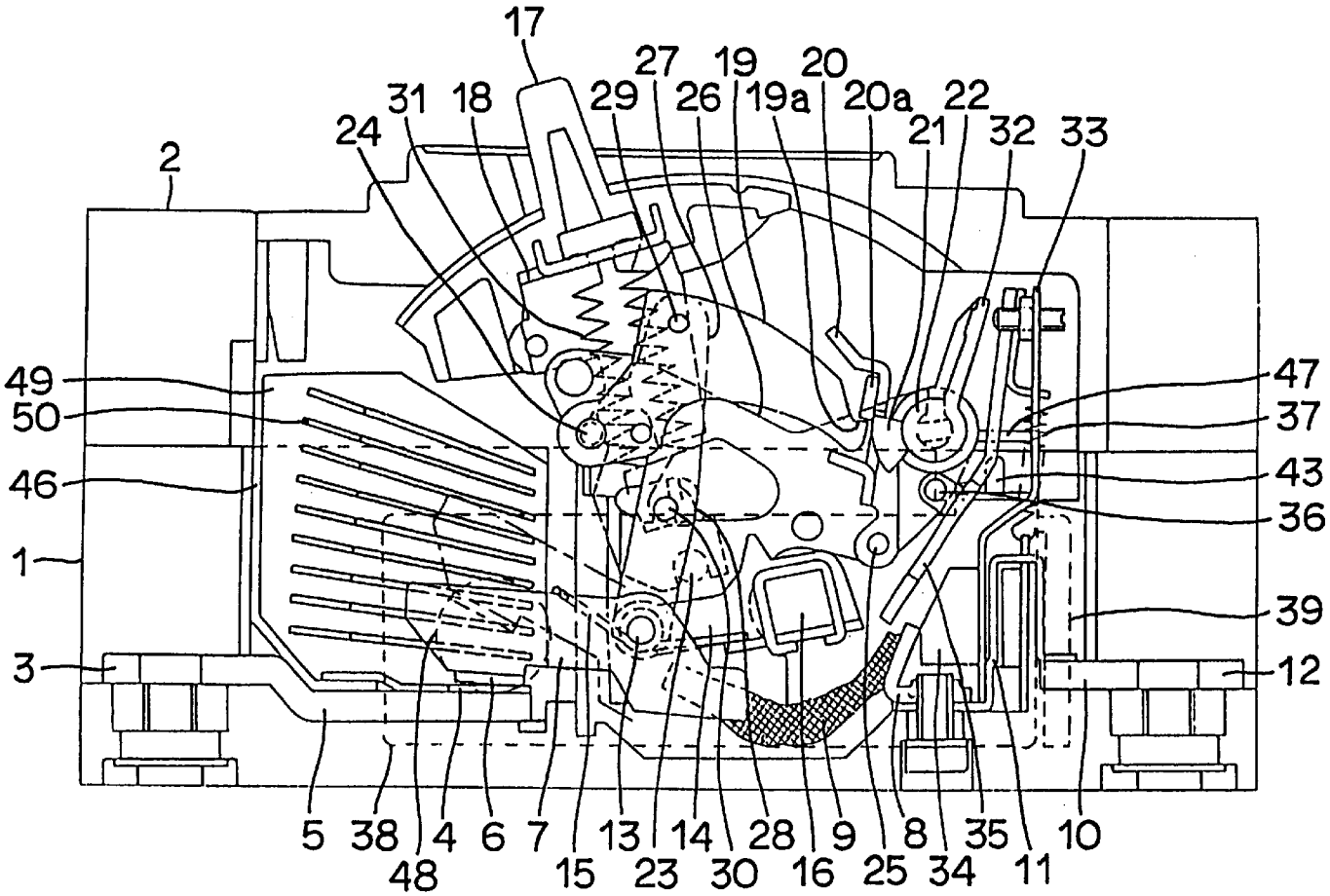
FIG. 1 is a cross sectional side view illustrating an ON state of a circuit breaker provided with a trip device of an embodiment of the invention.
Figure 2:
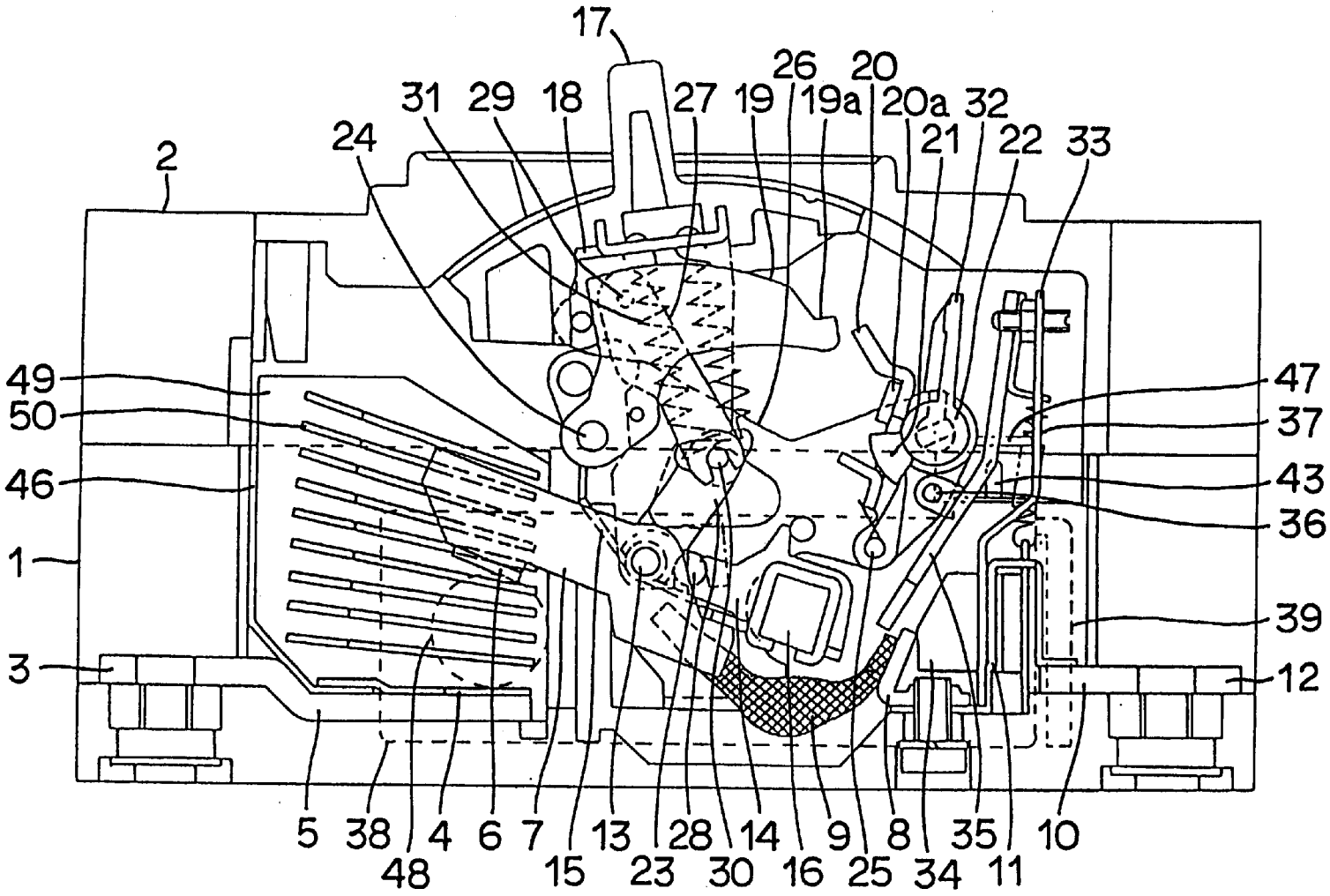
FIG. 2 is a cross sectional side view illustrating a tripped state of the circuit breaker shown in FIG. 1.
Figure 3:
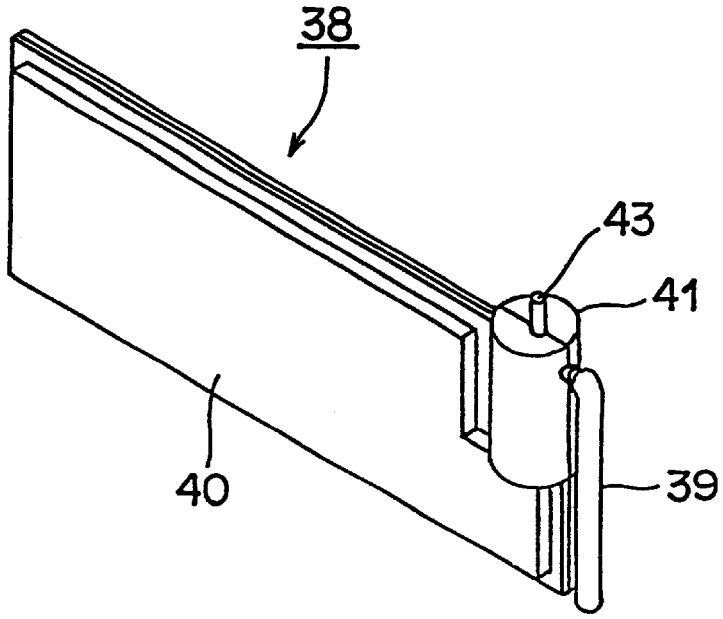
FIG. 3 is a perspective view of the trip device shown in FIG. 1 which is detached from the circuit breaker.
Figure 4:
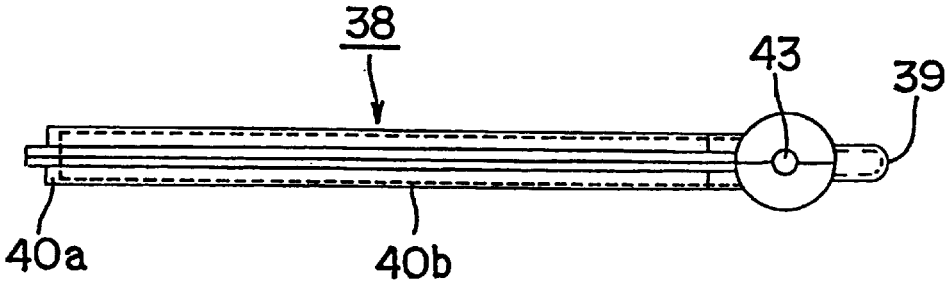
FIG. 4 is a plan view of the trip device shown in FIG. 1 which is detached from the circuit breaker.
Figure 5:
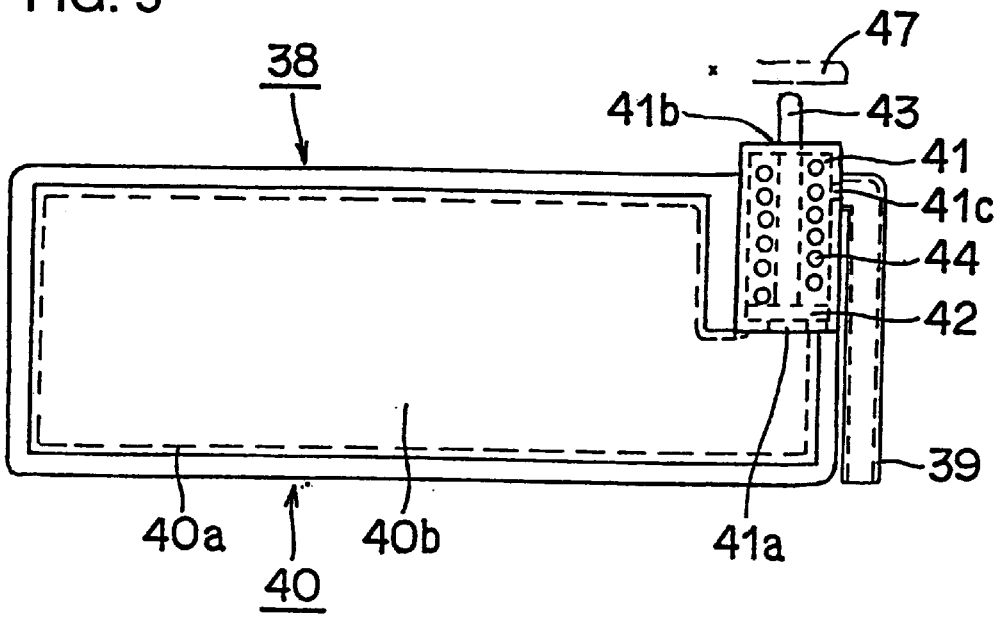
FIG. 5 is a side view of the trip device shown in FIG. 1 which is detached from the circuit breaker, illustrating a state in which a pressure detection space of the trip device is not pressurized.
Figure 6:
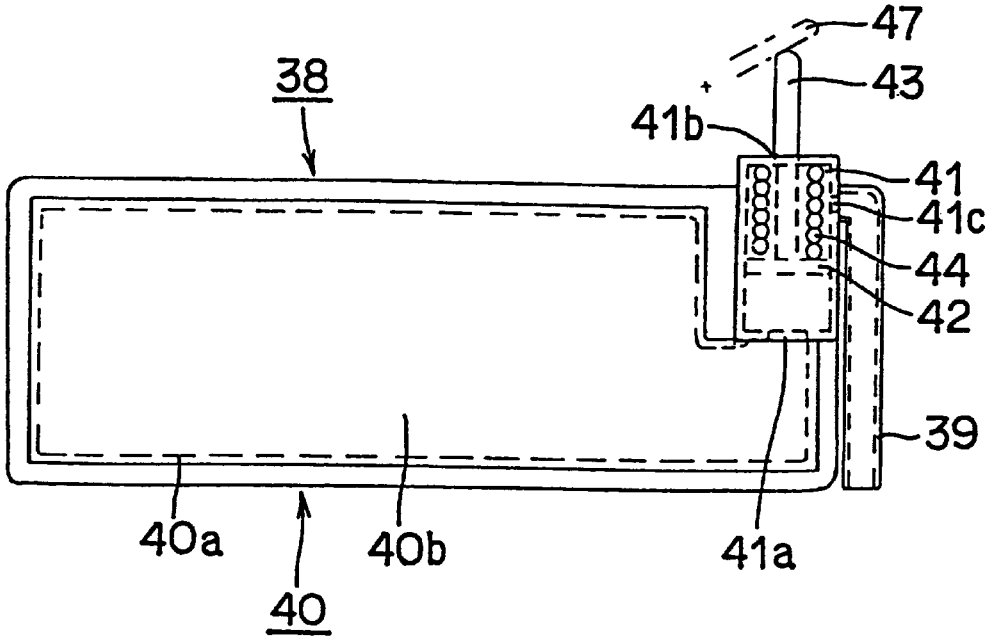
FIG. 6 is a side view of the trip device shown in FIG. 1 which is detached from the circuit breaker, illustrating a state in which the pressure detection space is pressurized.

Referring to FIGS. 1 and 2 illustrating a circuit breaker of three-pole type having a trip device of an embodiment, a casing constituted of a mold base 1 and a mold cover 2 that are made of insulating molding houses a main circuit conducting section including switching contacts, an operating mechanism for operating the switching contacts, a trip device for working the operating mechanism to open the switching contacts when an overcurrent flows, and an arc-extinguishing device for extinguishing arc which is generated when the current is broken by opening of the switching contacts.

The main circuit conducting section includes a connection terminal 3 associated with the power supply, a stationary contact base 5 having power supply connection terminal 3 at one end and a stationary contact 4 at the other end, a movable contact arm 7 having a movable contact 6 at one end which is associated with stationary contact 4, a flexible conductor 9 connected between the other end of movable contact arm 7 and a bent plate 8, a heater 11 of an inverted U shape having one end fixed to mold base 1 together with bent plate 8 and the other end connected to one end of a terminal conductor 10, and a load connection terminal 12 located at the other end of terminal conductor 10. Those components are provided to each pole.

Movable contact arm 7 is pivotally held by a contact holder 14 with a pin 13 and biased anticlockwise by a contact pressure spring 15. Contact holder 14 of each pole has its end held by a cross bar 16 of insulating material shared by respective poles. Three poles are simultaneously moved with cross bar 16 around a center of rotation of cross bar 16 as a point of support, by an operation of the operating mechanism common to these poles described later.

The operating mechanism is composed of an operating handle 17 formed of insulating material which is protruded from an opening of mold cover 2, an operating lever 18 having a shallow U shape cross section to which operating handle 17 is attached, a trip lever 19 having an engaging end 19*a* at one end, a hook 20 having an engaging piece 20*a* associated with engaging end 19*a*, a trip shaft 22 having a claw 21 for stopping rotation of hook 20 by engagement with it, a secured flame 26 which pivotally supports operating lever 18, trip lever 19 and hook 20 respectively by pins 23, 24 and 25 and pivotally supports trip shaft 22, a pair of toggle links 27 and 28, a pin 29 which couples toggle link 27 with the central upper end of trip lever 19, a pin 30 which couples toggle links 27 and 28, and an operating spring 31 placed between the upper end of operating lever 18 and pin 30. One end of toggle link 28 is coupled with pin 13.

In this embodiment, the circuit breaker is provided with both a conventional trip device and a trip device of the invention. Each of the trip devices operates when the overcurrent flows so as to rotate trip shaft 22. The conventional trip device is placed at each pole, and composed of a bimetal 33 attached to heater 11 such that its free end is opposed to a first trip piece 32 which is provided to each pole, an electromagnet formed of a stationary core 34 and a movable core 35 both placed to surround heater 11, a pin 36 which pivotally supports movable core 35, and a setting spring 37 which biases movable core 35 clockwise to make it apart from stationary core 34.

Referring to FIGS. 3 to 6, a trip device 38 of the invention includes a pressure detection space constituted of a pressure receiving chamber 40 formed by sticking a pair of symmetrical insulating moldings together, and a piston chamber 41. The pressure detection space is substantially closed. The insulating molding includes a shallow box-shaped portion having an almost rectangular frame portion 40*a* with some thickness as a side wall and having a thin plate portion 40*b* as a bottom. The insulating molding further includes a semi-cylindrical portion as made by cutting a cylinder along its center axis. The insulating moldings of the pair are opposed to each other and attached at their frame portions 40*a* and walls of the semi-cylindrical portions, producing pressure receiving chamber 40 corresponding to a space similar to a rectangular parallelepiped that is constituted of opposing thin plate portions 40*b* and attached frame portions, and piston chamber 41 formed as a cylinder.

The material and dimension of the insulating moldings are selected such that they have certain elasticity which allows thin plate portion 40*b* of pressure receiving chamber 40 to yield to the pressure of the arc gas generated at each breaking operation and return close to its original state upon depressurization, and they have a property which is not so significantly altered under the influence of a high temperature arc gas.

Piston chamber 41 has a hole 41*a* at its bottom to allow air flow to and from pressure receiving chamber 40, a hole 41b at its top for an operating rod 43 with its details given below, and a small hole 41*c* on its side to allow outside air to flow therethrough which is described below. When the insulating moldings of the pair are attached, piston chamber 41 is provided with a piston 42 which freely moves along its inner wall, operating rod 43 which is fixed to piston 42 and projects through an opening of piston chamber 41, and a return spring 44 which biases piston 42 inward, such that those components are enclosed in piston chamber 41. For discharging the air inside the piston chamber and for introducing the outside air, a tube 39 is placed at small hole 41*c*.

If thin plate portion 40*b* of pressure receiving chamber 40 is pressurized, the internal pressure increases to bias piston 42 against the action force of return spring 44 and accordingly push out operating rod 43. Operating rod 43 then pushes a second trip piece 47 placed at trip shaft 22 to initiate a tripping operation. At this time, the air inside piston chamber 41 is discharged through tube 39 and thus the air pressure in the piston chamber does not increase. Therefore, piston 42 speedily moves and the tripping operation is initiated immediately. If thin plate portion 40*b* is depressurized, the elasticity of thin plate portion 40*b* as well as the action force of return spring 44 allow pressure receiving chamber 40 and piston chamber 41 to return to their original states. When piston 42 of the piston chamber returns, the outside air is introduced through tube 39 so that the air pressure inside the piston chamber does not decrease and thus the piston is sure to return immediately.

Figure 7:
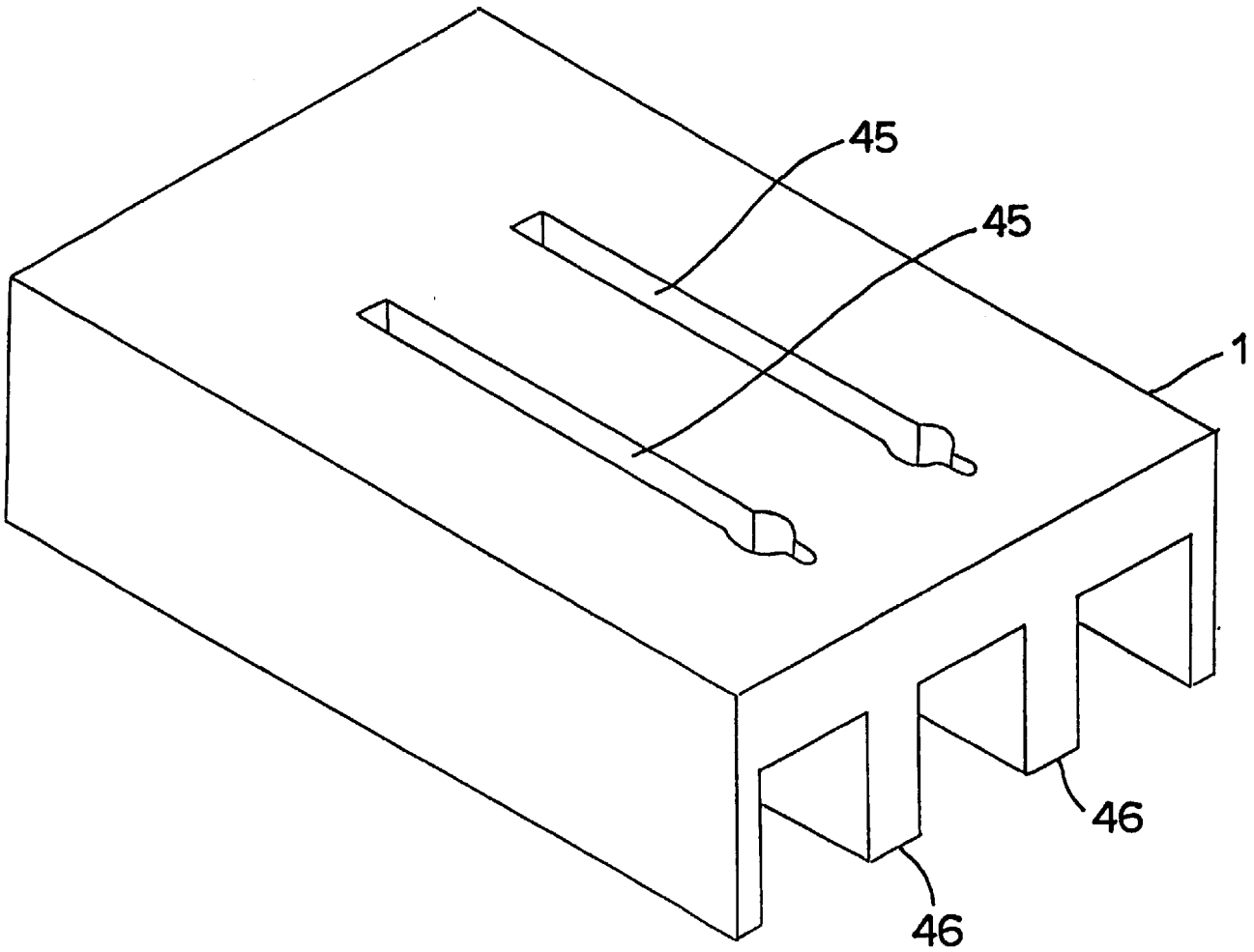
FIG. 7 illustrates an insertion opening for mounting the trip device of the invention.

Referring to FIG. 7, trip device 38 is inserted through a long and narrow opening 45 formed on the back of mold base 1 to be installed in a cavity formed in an inter-pole wall 46 of mold base 1 that separates a center pole and an end pole on either side. Pressure receiving chamber 40 of trip device 38 thus installed is located on the side of the switching contacts of the circuit breaker, and piston chamber 41 of trip device 38 is located such that operating rod 43 is opposite to the second trip piece 47 placed at trip shaft 22 as shown in FIGS. 1 and 2. Further, on both sides of inter-pole wall 46 at which pressure receiving chamber 40 is located, a large hole 48 is formed. Pressure receiving chamber 40 is thus interposed between the center pole and the end pole at the location of hole 48 and accordingly the poles are separated.

The arc-extinguishing device composed of a plurality of magnetic material plates 50 held between opposite insulation plates 49 is provided to each pole. The arc-extinguishing device functions to attract the arc generated upon opening of the switching contacts to magnetic material plates 50 by a magnetic function and accordingly extinguish the arc by a cooling function of magnetic material plates 50.

An operation of a circuit breaker having such structure is now described below.

FIG. 1 illustrates an ON state of the circuit breaker in which movable contact 6 is in contact with stationary contact 4 (shown by the solid line). In this state, trip lever 19 is biased anticlockwise via toggle link 27 by the function of operating spring 31, causing engaging end 19*a* to engage with the lower edge of engaging piece 20*a* of the hook 20 to push hook 20 clockwise. This pushing then causes the side surface of the lower right portion of engaging piece 20*a* to engage with claw 21 placed at trip shaft 22, and accordingly, trip shaft 22 is biased clockwise. These engaging relations are maintained since stopper means (not shown) is provided for preventing trip shaft 22 from further rotating clockwise from the shown position.

Operating handle 17 is biased anticlockwise by the function of operating spring 31 since pin 29 is located on the right side of the acting line of force of operating spring 31, while operating handle 17 is hindered from rotating by pin 24 of trip lever 19. Toggle links 27 and 28 are now substantially stretched, contact holder 14 is rotated anticlockwise via pin 13, and movable contact 6 is in contact with stationary contact 4. In this state of contact, a sufficient contact pressure is exerted by contact pressure spring 15.

In the ON state shown in FIG. 1, an OFF operation for opening the switching contacts of the circuit breaker is initiated by rotating operating handle 17 clockwise to move the acting line of force of operating spring 31 over a dead point positioned near pin 29, toggle link pin 30 is then pulled to the light, and toggle links 27 and 28 bend in dogleg form. As a result, contact holder 14 rotates clockwise (not shown) to separate movable contact 6 from stationary contact 4. An ON operation is done in reverse order.

A tripping operation is next described that is initiated by an operation of the trip device to open the switching contacts.

When a relatively small overcurrent flows through the circuit breaker, heater 11 is overheated to curve bimetal 33 to the left. After a relatively long time has passed, a screw attached to the free end of bimetal 33 pushes the first trip piece 32 to rotate trip shaft 22 anticlockwise. This rotation disengages claw 21 from engaging piece 20*a* to rotate hook 20 clockwise, and accordingly engaging piece 20*a* is disengaged from engaging end 19*a* to rotate trip lever 19 anticlockwise. This rotation of trip lever 19 moves pin 29 to the left side of the acting line of force of operating spring 31. When pin 29 moves over the dead point, toggle link pin 30 is pulled to the right and toggle links 27 and 28 are bent in a dogleg form, and consequently, the switching contacts are opened as shown in FIG. 2. It is noted that hook 20 and trip shaft 22 are biased clockwise by a return spring (not shown) having a weak action force. Therefore, they are returned as shown in FIG. 2.

In the tripped state shown in FIG. 2, operating handle 17 is positioned between the ON position and the OFF position. If operating handle 17 is rotated clockwise, a reset operation is realized to establish engagement between engaging end 19*a* and engaging piece 20*a* of the main hook and between engaging piece 20*a* and claw 21 of the trip shaft.

When a relatively high overcurrent such as the one having a value higher than a value set by setting spring 37 flows, a leg of the lower portion of movable core 35 is attracted to stationary core 34 by an electromagnetic attraction force substantially in an instant. Movable core 35 thus rotates anticlockwise, and its arm of the upper portion pushes the first trip piece 32 to rotate trip shaft 22. As a result, the switching contacts are opened as done by bimetal 33. Although the operation caused by the electromagnet is mentioned above as done in an instant, there is a considerable delay since a relatively large and heavy movable core is employed in order to set a high current value and generate the force to rotate trip shaft 22, and therefore the inertia of the movable core is not negligible.

If the overcurrent is like the short circuit current which is quite high compared with the set current value, trip device 38 of the invention operates to rotate trip shaft 22 before movable core 35 starts rotating. Specifically, when such a high current flows, a great electromagnetic repulsion force which exceeds contact pressure by contact pressure spring 15 acts between stationary contact 4 and movable contact 6. This electromagnetic repulsion force rotates movable contact arm 7 clockwise around pin 13 as shown by the chain line in FIG. 1 even if the operating mechanism does not work. Consequently, movable contact 6 separates from stationary contact 4 to generate arc of high temperature. This high temperature arc causes partial melting of metal components such as stationary contact 4, stationary contact base 5, movable contact 6, movable contact arm 7 and magnetic material plates 50, resulting in arc gas containing vaporized metal, and accordingly the pressure around switching contacts increases suddenly. The increased pressure is exerted via hole 48 of inter-pole wall 46 on pressure receiving chamber 40 to pressurize the elastic thin plate portion 40*b*. The volume of pressure receiving chamber 40 thus decreases and accordingly the pressure therein increases. As a result, piston 42 moves upward together with operating rod 43 to push the second trip piece 47 and rotate trip shaft 22 immediately.

After the current is broken, the pressure around switching contacts decreases to reach the atmospheric pressure, thin plate portion 40*b* returns nearly to its original state, and piston 42 and operating rod 43 are also returned to their original states by the function of return spring 44. Since the opening of tube 39 is located remotely from the region around switching contacts, the air taken into piston chamber 41 is a fresh and low temperature outside air. Therefore, the returning operation of trip device 38 is not interrupted by metal fractions generated when the current is broken. Trip device 38 is thus sure to operate even if an enormous current flows again.

A pair of insulating moldings each having the integrally shaped thin plate portion and frame portion constitutes pressure receiving chamber 40 of trip device 38 of the invention by attachment of the frame portions. Alternatively, thin plates having such an elastic modulus as that of the thin plate portions described above may be attached to both sides of a frame having a certain thickness to produce the pressure receiving chamber. Instead, the cavity in the inter-pole wall 36 may be utilized as the pressure receiving chamber by attaching a thin plate having the elasticity as described above to hole 48 of inter-pole wall 46, sealing opening 45 for inserting the trip device of the invention, and installing the piston mechanism at inter-pole wall 46 such that the piston mechanism is opposite to the second trip piece 47. Although the thin plate of the pressure detection space of the invention could be exposed to the high temperature arc gas as discussed above, the thin plate is pressurized with a considerably high pressure and the pressurized time period is short. Therefore, the thin plate of a small elastic modulus may be selected if it has an adequate heat-resistant property.

Although pressure receiving chamber 40 and piston chamber 41 are composed of a pair of integral moldings in this embodiment, they may separately be fabricated and connected by a pipe.

In addition, considering that the pressure of the entire housing of the switching contacts instantaneously increases upon occurrence of the arc, it is not necessarily required to place pressure receiving chamber 40 on the side of the switching contacts.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A trip device of a circuit breaker having switching contacts, an operating mechanism for opening and closing said switching contacts, a trip latch mechanism released to actuate said operating mechanism and open said switching contacts, and a housing for enclosing at least said switching contacts, said trip device comprising:

a pressure detection chamber having a pressure receiving portion with a deformable thin plate on which an arc gas applies pressure from outside said pressure detection chamber;

an operating rod operatively coupled to said pressure detection chamber for protruding when pressure in said pressure detection chamber increases; and a return spring for retracting said operating rod into said pressure detection chamber when pressure decreases, wherein said pressure detection chamber is arranged in the vicinity of said switching contacts without containing said switching contacts, and said operating rod releases said trip latch mechanism when it protrudes.

2. The trip device of the circuit breaker according to claim 1, wherein said pressure detection chamber is placed in a cavity formed in a surface wall of said housing, and a through a hole is formed at a wall which separates said cavity containing said pressure detection chamber from the space which contains said switching contacts.

3. The trip device of the circuit breaker according to claim 1, wherein said pressure detection chamber is formed of a cavity formed in a wall of said housing, a through hole formed at a surface wall which separates said cavity from said space, and said thin plate which is placed to close said through hole.

4. The trip device of the circuit breaker according to claim 2, wherein said circuit breaker is of a multiple type having switching contacts at each pole, and said pressure detection chamber is placed commonly to different poles adjacent to each other in said cavity in said wall of said housing which separates said different poles adjacent to each other.

5. The trip device of the circuit breaker according to claim 3, wherein said circuit breaker is of a multiple type having switching contacts at each pole, and said pressure detection chamber is placed commonly to different poles adjacent to each other in said cavity in said wall of said housing which separates said different poles adjacent to each other.

6. The trip device of the circuit breaker according to claim 1, wherein said pressure detection chamber has a small opening which allows outside air to flow.

* * * * *